US007017278B2

(12) United States Patent
Kato

(10) Patent No.: US 7,017,278 B2
(45) Date of Patent: Mar. 28, 2006

(54) MICROWAVE DRYING METHOD

(75) Inventor: Shigeki Kato, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/976,763

(22) Filed: Nov. 1, 2004

(65) Prior Publication Data

US 2005/0091870 A1 May 5, 2005

(30) Foreign Application Priority Data

Nov. 4, 2003 (JP) ..... 2003-373921

(51) Int. Cl.
*F26B 3/34* (2006.01)

(52) U.S. Cl. ..... 34/259; 219/699

(58) Field of Classification Search ..... 34/259; 219/699

See application file for complete search history.

(56) References Cited

U.S. PATENT DOCUMENTS

| | | | | |
|---|---|---|---|---|
| 6,768,089 | B1 | 7/2004 | Minobe et al. | |
| 2002/0109269 | A1 | 8/2002 | Miura et al. | |
| 2003/0057204 | A1 | 3/2003 | Minobe et al. | |
| 2004/0071611 | A1 * | 4/2004 | Hirose et al. | 422/180 |

FOREIGN PATENT DOCUMENTS

JP 2002-283329 A 10/2002

* cited by examiner

*Primary Examiner*—S. Gravini
(74) *Attorney, Agent, or Firm*—Oliff & Berridge, PLC

(57) ABSTRACT

A method for drying a plurality of objects in a same space using a microwave, a method of uniformly drying all the objects to be dried while retaining the high productivity (mass productivity) as much as possible is provided. The method comprises laying a plurality of objects to be dried apart from each other by keeping, as a shortest distance between at least one pair of adjacent objects among them a distance equivalent to ¾ or more of the wavelength of the microwave to be used and irradiating them with the microwave.

10 Claims, 1 Drawing Sheet

MICROWAVE DRYING METHOD

BACKGROUND OF THE INVENTION

1. Field of the Invention

The present invention relates to a method of drying a wet green body such as an undried green honeycomb structure using a microwave.

2. Description of the Prior Art

A honeycomb structure is widely used for a catalyst carrier and various filters, and recently has also attracted attention as a diesel particulate filter (DPF) for capturing particulates discharged from a diesel engine.

Honeycomb structures are made of a ceramics as major components. These honeycomb structures are usually manufactured by preparing clay by kneading a mixture of ceramic raw materials with water and various additives, extruding thus prepared clay into a formed product to obtain undried green honeycomb structures (hereinafter sometimes referred to as formed honeycomb structures), drying thus formed green honeycomb structures, and firing the resultant dried honeycomb structures.

A well known method of drying the formed honeycomb is a dielectric drying method in which high frequency energy generated by passing a current between electrodes installed in the upper portion and lower portion of the formed honeycomb product is used for drying. A hot air drying method in which a hot wind produced by a gas burner or the like is used is also well known. In recent years, a drying method using a microwave is used in place of or in combination with these drying techniques because of its advantages such as high drying speed and the reduced risk of deforming the objects to be dried.

In general, the microwave drying method is carried out by horizontally laying two or more objects to be dried in a same given space, such as a drying chamber of an oven, and irradiating the objects with a microwave generated by a microwave generating apparatus (See for example JP-A-2002-283329).

To increase productivity in drying formed honeycomb structures using the microwave drying method, it is desirable to minimize the distance between the objects to be dried that are laid within the same space such as turn tables or belt conveyers installed within the drying oven, thereby the number of the objects to be dried in one operation can be maximized. However, too narrow a distance between the objects to be dried causes a problem. This is because the uniform drying of all the objects laid within the same given space becomes difficult since the drying conditions would often vary, one by one within the objects laid in the same given space, depending upon the mutual distance between them.

SUMMARY OF THE INVENTION

The present invention has been completed in order to solve the problems mentioned above in conventional technologies. Therefore, the object of the present invention is to provide a method for uniformly drying all the objects laid within the same space with retaining the productivity (mass productivity) at a high level as much as possible, at the time when a plurality of the objects are simultaneously subjected to drying step by laying them within the same given space.

The above object can be achieved in the present invention by a microwave drying method for drying a plurality of objects comprising laying a plurality of objects to be dried is located apart from each other by keeping, as a shortest distance between at least one pair of adjacent objects among them, a distance equivalent to ¾ or more of a wavelength of a microwave to be used, and irradiating thus laid objects with the microwave.

According to the microwave drying method of the present invention, when a plurality of objects are simultaneously laid for drying in the same space, all the objects can be uniformly dried. In addition, high productivity can be ensured if the distance between at least a pair of the objects located adjacently that have the shortest distance therebetween among any pair of the objects located adjacently is set at a length as close as ¾ of the wavelength of the microwave, which is the lower limit specified by the present invention, for example, in a range of ¾ or more, but not more than the wavelength of the microwave used, because this distance allows as many objects as possible to be dried uniformly and efficiently at the same time. The expression "shortest distance between the objects (to be dried)" means, in the present specification, the shortest distance between at least one pair of the objects to be dried that are laid adjacently at the nearest position each other. This distance is sometimes referred to "the (mutual) distance between them", too. Therefore, at least a considerable number of pairs of the adjacent objects laid at the nearest position can meet this shortest distance, more effective drying can be achieved.

Other objects, features and advantages of the invention will hereinafter become more readily apparent from the following description.

DETAILED DESCRIPTION OF THE INVENTION AND PREFERRED EMBODIMENT

Figure 1:
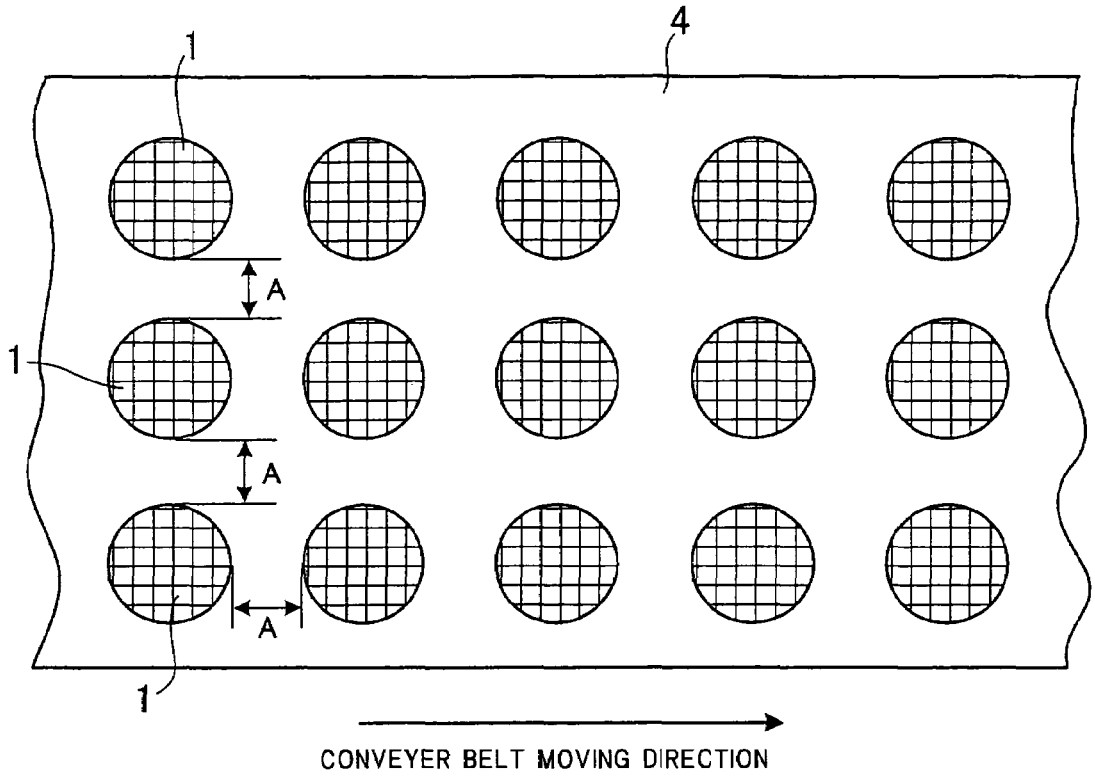
FIG. 1 is a schematic diagram showing an embodiment of the drying method of the present invention.

The microwave drying method of the present invention comprises laying a plurality of objects 1 to be dried at keeping a predetermined distance between them within same space as shown in FIG. 1, for example, a drying chamber of an oven, and irradiating thus laid objects with microwave, wherein the objects to be dried are laid apart from each other at a distance A which is equivalent to ¾ or more of the wavelength of the microwave. In the case of FIG. 1, a plurality of objects 1 to be dried are laid on a conveyor belt 4 to continuously dry these objects while moving the conveyor belt. However, the microwave drying method of the present invention is not limited to such a continuous mode. A batch drying mode in which the objects to be dried are not moved can also be employed.

With an objective of dissolving the problems of the uneveness in drying state among the dried products in the simultaneous drying of a number of objects to be dried laid within the same given space using a microwave, the present inventors have studied extensively, with paying attention to the relationship between the mutual distance between the objects to be dried and the wavelength of the microwave. As a result, the present inventors have found that if a plurality of objects 1 to be dried are laid apart from each other at a distance A equivalent to ¾ or more of the wavelength of the microwave, the plurality of objects 1 laid within same given space can be dried almost uniformly.

For example, in the case in which a microwave with a wavelength of 120 mm, which is the most commonly used wavelength in the microwave drying method, is used, the shortest distance between at least a pair of the objects located at the nearest position among the dried objects is 90 mm or more. When there are three or more objects to be dried, the mutual distances among all of these objects must be ¾ or more of the wavelength of the microwave, but it is not always essential to have all of the distances equivalent inasmuch as the distances are ¾ or more of the wavelength of the microwave.

However, too long a distance between the objects to be dried decreases the number of the objects which can be dried in one operation in the given space, resulting in decreased productivity (mass productivity). For this reason, the upper limit of the distance between the dried objects is preferably equivalent to or less than the wavelength of the microwave (for example, 120 mm or less when the microwave wavelength is 120 mm).

Although there are no specific restrictions to the objects to be dried by the microwave drying method of the present invention, the method is particularly suitably applied to drying formed honeycomb structures produced by extrusion molding, which are useful as a catalyst carrier and a diesel particulate filter for exhaust gas purification. According to the microwave drying method of the present invention, when a plurality of objects are simultaneously dried by laying them within the same given space, all the objects can be uniformly dried. In addition, high productivity can be ensured if the mutual distance between the objects to be dried is set at a length as close as ¾ of the wavelength of the microwave, which is the lower limit specified by the present invention, for example, in a range of ¾ or more, but not more than the wavelength of the microwave used, because this distance allows as many objects as possible to be dried uniformly and efficiently at the same time.

EXAMPLES

The present invention is described below in more detail by examples. However, the present invention is not limited to the following examples.

Example 1

A composition containing powders convertible into cordierite by firing, a binder, and a surfactant were kneaded with an addition of 22 wt % of water and the resultant was extruded to produce a given number of formed honeycomb structures, each having a diameter of 144 mm, a length of 220 mm, a wall thicknesses of 75 μm, and 600 cells/in$^2$ (93 cells/cm$^2$).

Figure 2:
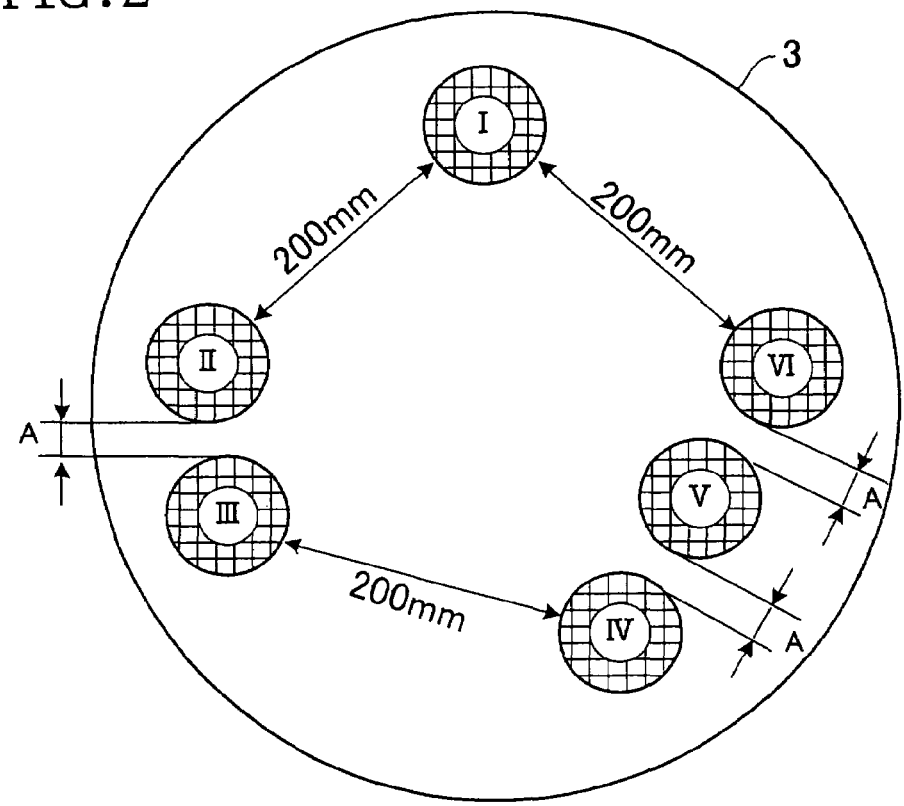
FIG. 2 is a schematic diagram showing the laying manner of formed honeycomb structures employed in Example 1.

The six honeycomb molded products I–VI were laid as shown in FIG. 2, keeping the predetermined distances, respectively, on a turn table 3 with a diameter of 1.2 m in a batch-type microwave oven having a microwave output of 15 kW to examine the effect of the distance between the honeycomb structures on drying them. Therefore, in the case of the honeycomb structure I, its shortest distance to the nearest adjacent honeycomb structures was set at 200 mm. The shortest distances, that is, the distances A between honeycomb structures II and III, IV and V, V and VI were varied, depending upon the predetermined distances of 0 mm, 60 mm, 90 mm or 120 mm, respectively. Note the distance of 0 mm means that the nearest adjacent honeycomb structures are laid each other in a such state that they were facing each other with contacting each other at a portion of their outer peripheral surface. Thus laid formed honeycomb structures were dried by irradiating a microwave at a wavelength of 120 mm to determine the respective rate of water removal. The results are shown in Table 1. The water removal rates in the Table below were determined from the following equation:

Water removal rate (%)=(Weight of the sample before drying−Weight of the sample after drying)/(Weight of the sample before drying)×100.

TABLE 1

| | Water removal rate (%) | | | | | |
|---|---|---|---|---|---|---|
| Distance A | I | II | III | IV | V | VI |
| 0 mm | 18.3 | 16.8 | 16.8 | 16.0 | 14.9 | 16.5 |
| 60 mm | 17.4 | 16.7 | 17.1 | 16.8 | 15.8 | 16.7 |
| 90 mm | 17.1 | 17.1 | 17.0 | 17.0 | 16.7 | 16.8 |
| 120 mm | 17.0 | 17.1 | 17.0 | 17.0 | 16.8 | 16.8 |

As shown in Table 1, when the distance A was from 0 to 60 mm, the water removal rate was low in the formed honeycomb structures, as is demonstrated by water removal rates of the structures II–VI which were laid close to the other formed honeycomb structures as compared with the formed honeycomb structure I laid in the position sufficiently apart from the other formed honeycomb structures. The formed honeycomb structure V which was laid between the formed honeycomb structures IV and VI exhibited a significantly different water removal rate as compared with the other formed honeycomb structures.

In contrast, when the distance A was 90 mm or more, there was almost no difference in the water removal rate among the formed honeycomb structures, indicating that all formed honeycomb structures were almost uniformly dried. Here, the mutual distance A of 90 mm between the respective formed honeycomb structures is equivalent to ¾ of the wavelength (120 mm) of the microwave used for the drying operation.

Example 2

The formed honeycomb structures with the same size as those in Example 1 were prepared. The formed honeycomb structures were laid as the objects 1 to be dried, shown in FIG. 1, on the conveyer belt 4 in a continuous-type microwave oven with a microwave output of 200 kW, and dried by irradiating a microwave at a wavelength of 120 mm while changing the mutual distance A between the formed honeycomb structures from 0 mm, 60 mm, 90 mm, and 120 mm to determine the rate of water removal at each distance A. As a result, as experienced in the batch-type drier used in Example 1, when the mutual distance A as the shortest distance between at least a pair of the honeycomb structures located adjacently at the nearest distance was 90 mm or more, all the formed honeycomb structures were almost uniformly dried, with almost no difference in the water removal rate among the formed honeycomb structures.

The method of the present invention is particularly suitably applied to drying formed honeycomb structures produced by extrusion molding, which are useful as a catalyst carrier and a diesel particulate filter for exhaust gas purification.

Obviously, numerous modifications and variations of the present invention are possible in light of the above teachings. It is therefore to be understood that, within the scope of the appended claims, the invention may be practiced otherwise than as specifically described herein.

The invention claimed is:

1. A microwave drying method for drying a plurality of objects comprising:

laying the plurality of objects to be dried apart from each other and keeping, as a shortest distance between at least one pair of adjacent objects among the plurality of objects, a distance equivalent to ¾ or more of a wavelength of a microwave to be used to dry the plurality of objects, and irradiating the laid objects with the microwave.

2. The microwave drying method according to claim 1, wherein at least one pair of the plurality of objects to be dried is laid apart by keeping, as a shortest distance therebetween, a distance equivalent to ¾ or more of, but not more than the wavelength of the microwave to be used.

3. The microwave drying method according to claim 1, wherein the method is carried out batch-wise.

4. The microwave drying method according to claim 2, wherein the method is carried out batch-wise.

5. The microwave drying method according to claim 1, wherein the method is continuously carried out.

6. The microwave drying method according to claim 2, wherein the method is continuously carried out.

7. The microwave drying method according to claim 1, wherein a microwave with a wavelength of 120 mm is used.

8. The microwave drying method according to claim 2, wherein a microwave with a wavelength of 120 mm is used.

9. The microwave drying method according to claim 1, wherein the objects to be dried are honeycomb molded products.

10. The microwave drying method according to claim 2, wherein the objects to be dried are honeycomb molded products.

* * * * *